US005201505A

United States Patent [19]

Shah

[11] Patent Number: 5,201,505

[45] Date of Patent: Apr. 13, 1993

[54] DOCUMENT FEEDER OVERLAID TRAYS CONFIGURATION

[75] Inventor: Narendra C. Shah, Penfield, N.Y.

[73] Assignee: Xerox Corporation, Stamford, Conn.

[21] Appl. No.: 812,610

[22] Filed: Dec. 23, 1991

[51] Int. Cl.[5] ..... B65H 1/26

[52] U.S. Cl. ..... 271/3; 271/207

[58] Field of Search ..... 271/3, 3.1, 207

[56] References Cited

U.S. PATENT DOCUMENTS

| | | | |
|---|---|---|---|
| 3,868,019 | 2/1975 | Stemmle . | |
| 4,023,791 | 5/1977 | Hori et al. | 271/3 |
| 4,884,794 | 12/1989 | Dinatale et al. | 271/3 |
| 5,033,728 | 7/1991 | Miura et al. | 271/3 |

FOREIGN PATENT DOCUMENTS

| | | | |
|---|---|---|---|
| 275950 | 11/1987 | Japan | 271/3.1 |
| 17724 | 1/1989 | Japan | 271/3 |
| 181631 | 7/1989 | Japan | 271/3 |

OTHER PUBLICATIONS

Xerox 5034 Copier Sales Brochure, 2 pages (1990).

*Primary Examiner*—Robert P. Olszewski
*Assistant Examiner*—Steven M. Reiss

[57] ABSTRACT

In a document handler for a copier or scanner imaging station in which a separate document input loading tray and a document restacking output tray are provided, but with both trays being superposed over the imaging station and one another for compactness; the document input tray is only partially underlying the output tray, has a substantially fully supportive surface, and is adapted to fully support document feeding into an input end of the document handler; and the document restacking output tray (except for an initial portion at its opposite end entrance area) consists of only a thin, rear edge only, shelf, overlying not more than a minor rear portion of the input tray in at least that portion of the input tray adjacent the input end of the document handler into which documents are to be fed, so as to provide open document loading access. The width of the document restacking output tray rapidly arcuately transitions by narrowing to this thin rear edge shelf portion as it extends away from the output end of the document handler. This tray may be a semi-transparent plastic plate, and the initial portion may have an uphill slope.

3 Claims, 1 Drawing Sheet

DOCUMENT FEEDER OVERLAID TRAYS CONFIGURATION

Figure 1:
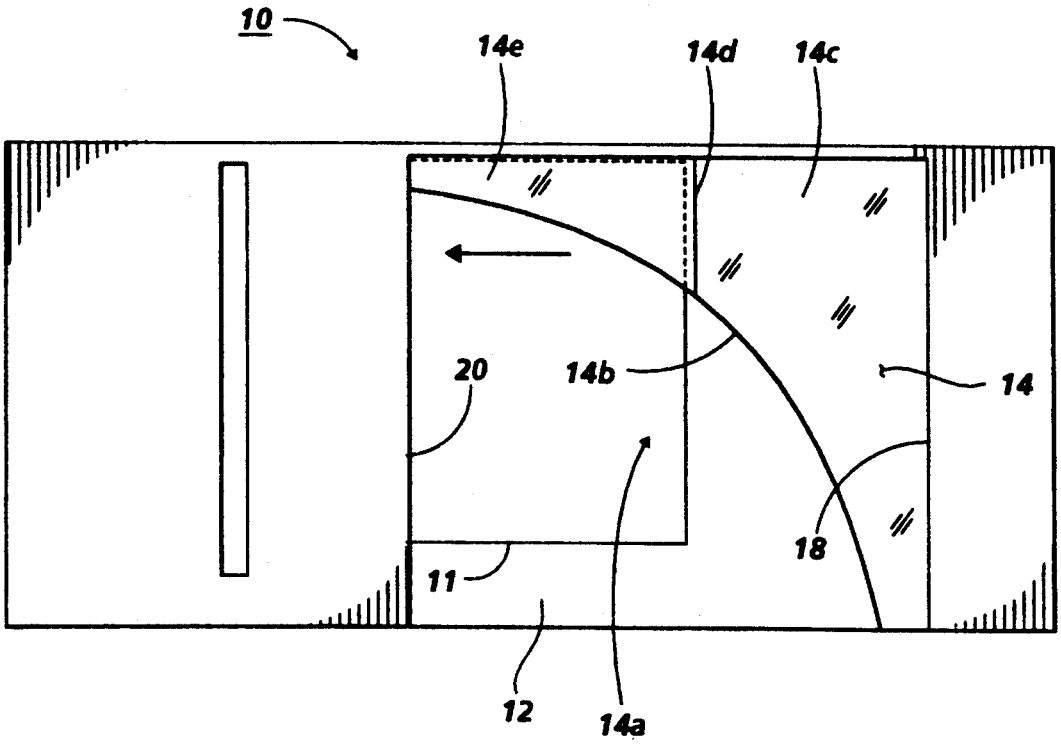

There is disclosed herein a simple, very compact, low cost, over-platen document handler with proper document restacking re-collation.

Compact and light weight over-platen document handlers or feeders (the terms are often interchanged in the art) are well know and desirable. Particularly, document handlers which do not exceed the dimensions of even a small copier or scanner. Most simple document feeders involve at least one of the trays hanging off or projecting from one side of the copier or scanner, as in U.S. Pat. Nos. 4,422,751; 4,954,847; 4,984,779; or many other examples. However, there is also a type of document feeder in which both the input and output (restacking) tray surfaces are located over the platen area (superposed relative to one another and the platen) as in U.S. Pat. No. 4,884,794 issued Dec. 5, 1989 to E. L. Dinatale et al. U.S. Pat. No. 4,023,791, the FIG. 7 embodiment, also shows a document feeder or handler with a restack tray over the platen but under the document input surface, although with a single sheet (semi-automatic) input surface rather than a plural stacked sheet input feeder and tray.

Other art of background interest includes various know partial tray cutouts for improved unloading of sorters, e.g., Xerox Corporation U.S. Pat. No. 3,868,019, especially FIG. 7.

Having both the input and output stacking trays located over the imaging station is desirable for compactness. However, it is also important that the "originals" being imaged at the imaging station (platen) are restacked in the same page order in which that document job set was loaded (stacked) into the document handler, to avoid manual re-collation of the documents. That depends on the number of inversions in the document path, whether the documents are loaded, and/or fed, and/or restacked, face-up or face-down, and whether the documents are thus sequentially fed or restacked in forward (1 to N) page order or reverse (N to 1) page order. While bottom of stack rather than top of stack restacking is possible, it is more difficult and less desirable.

Using a single, common tray for both input and output (restacking) is also well known, for recirculating document handlers (RDH), but this normally requires a more reliable variable normal force bottom (of stack) document feeder, such as a corrugating vacuum feeder. It also requires a stable mechanical set separator mechanism. Examples of such RDH's are shown in various U.S. Pat. Nos. such as 4,831,419; 4,974,035; 5,026,044; and other RDH patents cited therein. Thus, for a simpler, lower cost, and lighter weight document feeder, a document feeder with separate input and output document trays is normally desirable.

In particular, in a document feeder for an electronic digital imaging station, whether part of a copier, or a printer, or a stand-alone scanner component, remotely networked, the documents only need to be fed once, and the scanned-in images electronically stored and/or reordered for subsequent copies, so physical document recirculation by a RDH is not needed, but desktop space conservation may be even more important. Thus, for either that application, or for small conventional optical imaging copiers, stacking or superimposing the input and output trays of the document feeder directly vertically above the imaging station (platen) is desirable.

It is desirable in some applications, as here, for the input tray to be the lower most of the two superposed trays. For example, so that the upper, restacking tray can be lighter, (not having an associated feeder) or more angled relative to the horizontal, and so that the lower tray can be closer to the document feeder frame and the platen transport. However, when the two trays are thus superposed, the overlying output tray can interfere with operator loading of the underlying input tray, and the present invention provides relief for this problem.

If, alternatively, the upper tray is the input tray, it can interfere with unloading documents stacked in the underlying restacking tray. A relatively small partial tray cutout can be provided at the rear of an uppermost input tray for assisting removal of documents from an underneath restacking tray, as in the Xerox Corporation "5034" copier document feeder. However, an input tray must normally provide full-width, fully underlying, planar support for the documents to be fed, in order to not interfere with feeding or not to cause skewed feeding by uneven document sheet feeding resistance if one edge of the input stack is unsupported or sags, or if there is more resistance to the sheet being fed by the underlying tray on one side than the other.

A fully horizontal restacking tray tends to restack more unevenly than an inclined restacking tray, and is thus less desirable. One solution to the problem of interference with document loading if there is an overlying sheet restacking tray is to make the restacking tray semi-vertically inclined, with its input at the opposite end or side of the document handler from the document input end or side. However, there are other disadvantages in restacking with that solution, such as undesirably requiring the sheets to be pushed uphill into such a semi-vertical restacking tray, and it still does not provide fully unrestricted loading access to the underlying input tray.

In contrast, in the system disclosed in the embodiment hereinbelow, restacking is primarily provided on a closely adjacent but only a partially overlying shelf surface extending along a minor rear portion of the over-platen area of the document handler, not overlying most of the normal document input area.

A specific feature of the specific embodiment(s) disclosed herein is to provide in a document handler for a copier or scanner imaging station in which a separate document loading input tray and a document restacking output tray are provided, with both said document loading input tray and said document restacking output trays being vertically superposed over said imaging station for overall compactness of said document handler; the improvement wherein: said document input tray comprises a substantially fully document supportive tray surface only partially underlying said document restacking output tray and adapted to support documents feeding into an input end of the document handler; and wherein said document restacking output tray is adapted to receive therein documents for restacking ejected from an opposite, output end, of said document handler; and wherein said document restacking output tray primarily comprises only a thin, rear edge, shelf portion spaced from and overlying not more than a minor rear portion of said document loading input tray in that portion of said input tray adjacent said input end of said document handler so as to provide open document loading access to said document loading input tray.

Further specific features provided by the system disclosed herein, individually or in combination, include those wherein said document restacking output tray also has a minor initial portion, adjacent only said output end of said document handler with a front to rear width, substantially overlying the width of said document input tray, and wherein said width of said document restacking output tray rapidly transitions by rapidly narrowing to said thin, rear edge shelf portion as said document restacking output tray extends away from said output end of said document handler, so as to provide unobstructed document loading access to a major area of said document loading input tray; and/or wherein said document restacking output tray is a semi-transparent plastic plate member; and/or wherein said minor initial portion of said document restacking output tray has an uphill slope, and said thin rear edge shelf portion is generally horizontal.

In the description herein the term "document" or "sheet" refers to a usually flimsy sheet of paper, plastic, or other such conventional individual image substrate.

All references cited in this specification, and their references, are incorporated by reference herein where appropriate for appropriate teachings of additional or alternative details, features, and/or technical background.

Figure 2:
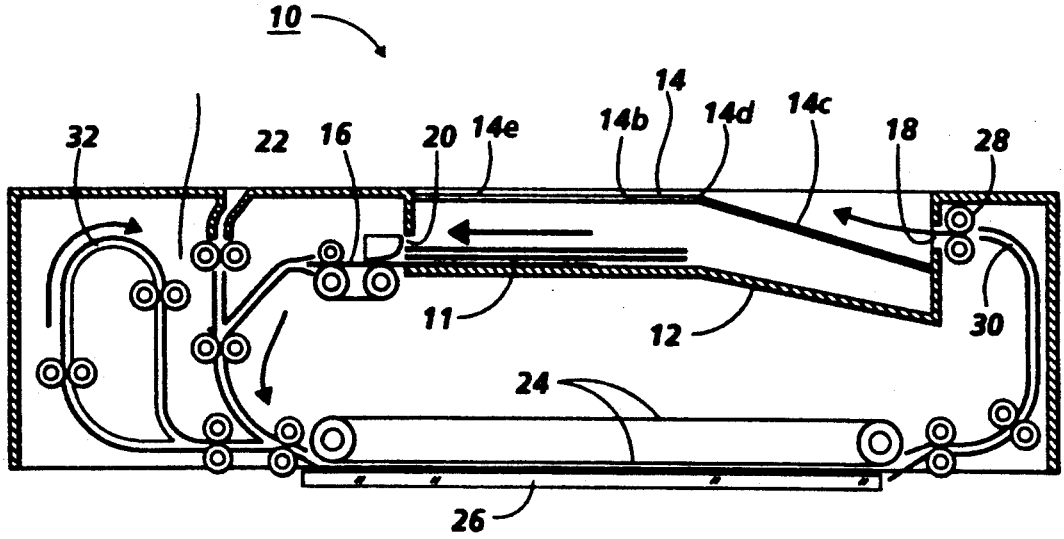

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

FIG. 1 is a schematic top view of one example of a document handler incorporating the present invention; and FIG. 2 is a schematic cross-sectional side view of the document handler of FIG. 1.

Describing now in further detail the exemplary embodiment with reference to the Figures, there is shown a redesign of an automatic document feeder (ADF) 10, like that of U.S. Pat. No. 4,884,794 cited above, to ensure that its originals 11 input tray 12 and exit or output tray 14 do not undesirably interfere with each other. As shown, this is a very simple and inexpensive system. The concept here involves a variable width, primarily narrow partial shelf functioning as the tray 14. This partial shelf output "tray" 14 can be made of known smoked, (semitranslucent) plastic plate material, and simply snapped in or glued on, yet prevents the restacking output sheets from being refed into the document feeder 16. The exit tray 14 has a large front cut-away area **14*a* to allow the operator to readily place the originals 11 in the lower tray 12. This allows most of same basic over-platen area to be used for document input, and then for auto-restack, with the documents restacking above the input tray 12. This partial shelf 14 is only a full-width shelf at most only at the very rear of the document loading area, for only the largest size documents, adjacent end 18. Tray 14 arcuately transitions from a substantially full-width tray 14*c* at 18 to only a minor portion 14*e* of a full-width tray from the restack entrance end 18 towards the opposite or feeder 16 input end 20 of the tray 12, where the operator must insert the documents 11. Most of the document area of the restacking documents is unsupported here yet this only partial tray 14 still prevents restacking documents from re-entering the document feeder 16**.

In this ADF embodiment 10, documents 11 loaded face-up into lower tray 12 with lead edges inserted into feeder 16 input 20 are conventionally fed by feeder 16 from the bottom of the stack here sequentially through a first inversion (semi-cylindrical) path 22 to a friction belt platen transport 24, fed into the desired imaging position overlying imaging platen 26, then fed to output transport rollers 28 in a second inversion and output path 30 to eject at end 18 the documents 11 sequentially into output tray 14, to sequentially restack therein, face-up, N to 1, as originally fed, and thus properly re-collated. If the documents are duplex, an additional document inverter loop path 32 may be utilized to copy both sides, as also described in said U.S. Pat. No. 4,884,794[note that the trays 12, 14 here are reversed in positions there]. It will be appreciated that this ADF 10 is merely one example of a document handler with which the concept here may be employed.

The restacking tray 14 here is not really a tray in the normal sense. It is primarily only a partial shelf primarily only along the rear of a normal tray, (the side away from the operator) thus exposing most of the actual document input area of tray 12 without any obstruction. To express this another way, the tray 14 has a large cut-away area **14*a*, defined by a large radius arcuate front edge 14*b***.

In this embodiment, the tray 14 also has an initial upwardly sloping portion **14*c*, starting at end 18, but transitioning at 14*d* to a generally horizontal portion 14*e*. The underlying input tray 12** here has a similar side view (FIG. 2) configuration for compactness, but does not have a corresponding cut-away portion, so as to retain uniform document support and friction for in-feeding.

The curve **14*b* defining the large cut-away portion 14*a* of the tray 14 results in only a very narrow shelf portion 14*e* relative to the width of tray 12 near the document loading input end 20, thus, not substantially obstructing normal document set loading. Yet at the opposite end of the document handler 10, where the exit path 30 ejects at 18 documents into restacking tray 14, there is a brief entrance area of section 14*c* of the tray 14 substantially the full width of the document path and tray 12 to insure that at the start 18 of restacking, at the downhill end of this tray 14, the tray 14 can provide adequate guidance or support for the initial restacking of documents 11. Then, shortly after (downstream of) the sheet ejection point 18, the tray 14 is sharply cut back (the start of 14*b*) towards the rear of the document handler 10, transitioning rapidly to the thin, rear edge (only), minor shelf portion 14*e***.

However, it has been found that the combination of the initial or rear end only support of both the front and back side edges of the documents 11 at **14*c*, together with the continued back side edge only support of the documents along shelf 14*e*, is together capable of keeping the restacking documents separated from the underlying initially loaded documents 11 on tray 12, and to keep the restacking documents on tray 14 from entering feeding entrance 20 at the opposite end of the document handler and being refed by feeder 16. Also, the dimensions are preferably such that few documents are long enough to extend the full length of shelf 14*e*. Also, the uphill section 14*c* encourages documents to slide back down the sloped surface 14*c* and restack aligned with the wall surface under restacking exit 18. A known type of knockdown brushes or flappers rotated on an exit roller 28** can assist trail edge knockdown restacking assistance, if desired.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a document handler for a copier or scanner imaging station having a document loading input tray and a separate document restacking output tray, with both said document loading input tray and said document restacking output tray being positioned to be vertically superposed over said imaging station for overall compactness of said document handler; and wherein documents are fed from said document loading input tray into an input end of said document handler and wherein documents are fed from an opposite, output, end of said document handler into said restacking output tray; the improvement wherein:

said document loading input tray comprises a substantially planar and fully supportive tray surface for fully supporting documents feeding into said input end of said document handler, said document restacking output tray is spaced above said document input tray and is adapted to receive thereon but only partially support documents for restacking thereon which are ejected from said opposite, output, end of said document handler, said document restacking output tray being adapted to support only a minor portion of said restacking documents therein, said document restacking output tray primarily comprising only a thin, rear edge, shelf portion overlying only a minor rear portion of said document loading input tray, said document restacking output tray having only a minor initial portion adjacent only said output end of said document handler having a front to rear width substantially overlying said document input tray, and said width of said document restacking output tray rapidly narrows to said thin, rear edge shelf portion as said document restacking output tray extends away from said output end of said document handler, so as to provide unobstructed document loading access to a major area of said document loading input tray.

2. The document handler of claim 1, wherein said document restacking output tray is a thin, semi-transparent plastic plate.

3. The document handler of claim 1, wherein at least said minor initial portion of said document restacking output tray has an uphill slope.

* * * * *